US008839715B2

(12) United States Patent
Doaran et al.

(10) Patent No.: US 8,839,715 B2
(45) Date of Patent: Sep. 23, 2014

(54) TRASH COMPACTOR MAIN DOOR INTERLOCK

(75) Inventors: Van Doaran, Long Beach, CA (US); Thomas Lee, Coto De Casa, CA (US); Sohiel Azizi, Irvine, CA (US); Fred Reed, Brea, CA (US)

(73) Assignee: MAG Aerospace Industries, LLC, Carson, CA (US)

( * ) Notice: Subject to any disclaimer, the term of this patent is extended or adjusted under 35 U.S.C. 154(b) by 366 days.

(21) Appl. No.: 13/094,468

(22) Filed: Apr. 26, 2011

(65) Prior Publication Data

US 2011/0259215 A1 Oct. 27, 2011

Related U.S. Application Data

(60) Provisional application No. 61/343,262, filed on Apr. 26, 2010.

(51) Int. Cl.

| | |
|---|---|
| ***B30B 15/00*** | (2006.01) |
| ***B30B 15/28*** | (2006.01) |
| ***B30B 9/30*** | (2006.01) |

(52) U.S. Cl.

CPC ..... *B30B 9/3032* (2013.01); *B30B 15/28* (2013.01)

USPC ..... 100/341

(58) Field of Classification Search

USPC ..... 100/226, 229 A, 240, 245, 341, 345, 347

See application file for complete search history.

(56) References Cited

U.S. PATENT DOCUMENTS

| | | | | | |
|---|---|---|---|---|---|
| 3,845,707 | A | | 11/1974 | Enright et al. | |
| 3,859,911 | A | * | 1/1975 | Karls et al. | 100/215 |
| RE28,748 | E | * | 3/1976 | Fredrickson | 100/218 |
| 4,005,648 | A | * | 2/1977 | Edwards | 100/345 |
| 4,424,740 | A | * | 1/1984 | Gwathney et al. | 100/52 |
| 4,711,390 | A | | 12/1987 | Andrews et al. | |
| 5,024,151 | A | | 6/1991 | Girardin et al. | |
| 5,575,199 | A | * | 11/1996 | Yamamoto | 100/34 |
| 6,367,377 | B1 | * | 4/2002 | Gawley et al. | 100/49 |

FOREIGN PATENT DOCUMENTS

| | | |
|---|---|---|
| EP | 0668149 EP | 8/1995 |
| WO | 2011139690 A1 | 11/2011 |

OTHER PUBLICATIONS

International Search Report and Written Opinion dated Oct. 11, 2011 in related Application No. PCT/US2011/033943.

* cited by examiner

*Primary Examiner* — Jimmy T Nguyen
*Assistant Examiner* — Chwen-Wei Su
(74) *Attorney, Agent, or Firm* — Kilpatrick Townsend & Stockton LLP; Dean W. Russell, Esq.; Kristin M. Crall, Esq.

(57) ABSTRACT

Embodiments of the present invention relate generally to door locking systems for use in connection with trash compactor systems for preventing inadvertent opening of the main door during a compaction cycle.

12 Claims, 5 Drawing Sheets

TRASH COMPACTOR MAIN DOOR INTERLOCK

This application claims the benefit of U.S. Provisional Application Ser. No. 61/343,262, filed Apr. 26, 2010 titled "InFlight Trash Compactor Main Door Interlock," the entire contents of which are hereby incorporated by reference.

FIELD OF THE INVENTION

Embodiments of the present invention relate generally to door locking systems for use in connection with trash compactor systems for preventing inadvertent opening of the main door during a compaction cycle.

BACKGROUND

Collecting and disposing of trash in confined conditions, particularly on-board passenger transport vehicles, such as aircraft, trains, ships, buses, RVs, and other water or air travel vessels can be challenging. However, a good deal of rubbish is generated on such vehicles. For example, after in-flight beverage service, unused items are collected, which often includes drink cups, napkins, newspapers, food wrappers, tea bags, beverage cans, other packaging or non-consumable items and the like, food wastes, or any other type of disposable item that a passenger may consume or bring on-board.

Trash compactors are thus often used in aircraft and other vehicle galleys in order to manage the amounts of trash generated. If the main door of the trash compactor is opened during a compaction cycle, there are built-in safety sensors on the main door that deactivate the downward movement of the platen (the plunger-like plate that raises and lowers in order to compress the trash in the compactor unit) to prevent harm to the user. Although this deactivation addresses a definite safety need, it fails to address the nuisance that occurs when the main door is opened before the trash container in the unit is full.

Because compaction applies a substantial load on the contents of the trash container in the compactor unit, the sides of the container exert a continuous force against the main door and walls of the compactor unit. This force causes the container to expand, press, or bulge outwardly against the door and walls—this is normally not of concern because the container is supported and contained by all sides of the compactor unit. However, if the main door is prematurely opened during the compaction cycle when the platen is applying pressure or force to the container contents, it causes the container to bulge out the front door opening. The container can also bulge out if the main door is opened at any time between one of the compaction cycles, but before the container is entirely full and ready to be removed from the unit. Once the container bulges out, it is difficult (if not impossible) to re-close the front door in order for the compression/compaction cycle to continue. Consequently, no more trash can be loaded, and no more compaction cycles can take place. The partially full box must be removed and replaced with an empty box. If the platen gets jammed where it can't be retracted, the attendant usually has to rip the trash container apart, empty its contents on the floor, position a new container in the compactor unit, re-load the trash into the new container, and being the compaction cycle again. This is a messy and time-consuming process.

Accordingly, it is desirable to provide a mechanism that prevents the main door of a trash compactor from being opened any time that a compaction cycle is taking place.

BRIEF SUMMARY

Embodiments of the present invention relate generally to door locking systems for use in connection with trash compactor systems for preventing inadvertent opening of the main door during a compaction cycle. They provide a trash compactor main door interlock, comprising an actuator configured to indicate that a compaction cycle has begun; and a lock system configured to be activated by the actuator and to restrain the main door from opening. The actuator may be mechanically or hydraulically activated.

In a specific embodiment, the lock system comprises a vertical rod, a hinge member, and a horizontal rod. The actuator causes the vertical rod to press against the hinge member, pressure on the hinge member causes the horizontal rod to extend toward a handle of the main door, and extension of the horizontal rod causes the rod to restrain a handle of the main door.

DETAILED DESCRIPTION

Embodiments described provide a main door interlock that prevents the front main door handle of the trash compactor unit from being pulled open when the platen is in motion, thus preventing the door from opening. The main door interlock may be mechanically, electrically, or hydraulically activated. In either instance, the main door mechanisms are similar. Alternate embodiments provide a main door interlock that can prevent the handle from being opened at any time before the final compaction has taken place. This may be accomplished by an electrical circuit, a solenoid system that be insert and extract a pin from the door handle, or any other appropriate means.

In a first mechanical embodiment, the mechanical design allows the movement of the trash compacting platen to activate the interlock. This way, any time a compaction cycle occurs, the main door cannot be opened. In a second hydraulic embodiment, the hydraulic pressure used to push the cylinders behind the platen is secondarily used to activate the interlock. Activation of the interlock will thus lock the main door any time a compaction cycle takes place. Although not shown, it is understood that any other mechanisms may be used to ensure that the main door remains closed for the desired duration, either when the platen is in motion or until the final compaction cycle has occurred.

Figure 1:
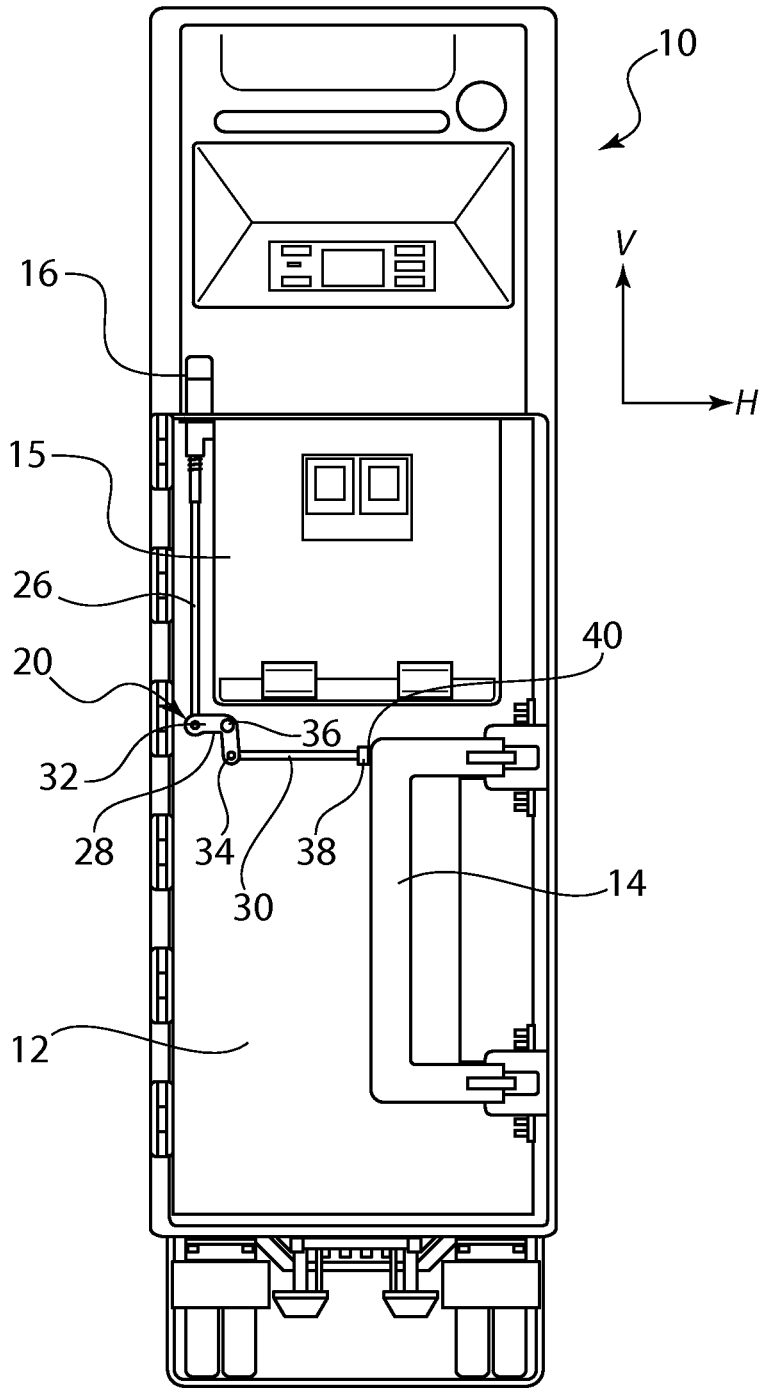
FIG. 1 shows a front plan view of one embodiment of a main door interlock.

In the embodiment shown in FIG. 1, trash compactor unit 10 is shown having its front cover removed so that the inner workings are visible. Unit 10 has a main door 12 with a handle 14 and a waste flap 15. In use, trash is delivered to the interior of the unit through waste flap 15 (which is typically a trash door that opens outwardly to create a trash chute), into a trash container (which is typically a specially designed cardboard box) positioned in the interior of the unit 10.

An actuator 16 or 18 is provided that is configured to indicate that a compaction cycle has begun. For example, the actuator 16 may be a mechanical actuator that physically actuates or moves or otherwise alerts the door locking system that the platen has begun movement. In one embodiment, actuator 16 may have a portion that provides an internal feature or hinge that cooperates with a portion of the platen, such that when the platen physically moves against or pushes the feature or hinge, it indicates that the compaction cycle is in progress. When the actuator 16 is not being pushed or moved by the platen, the remaining portions of the main door interlock (described below) maintain a default open position and the main door remains in its unlocked position.

Figure 2:
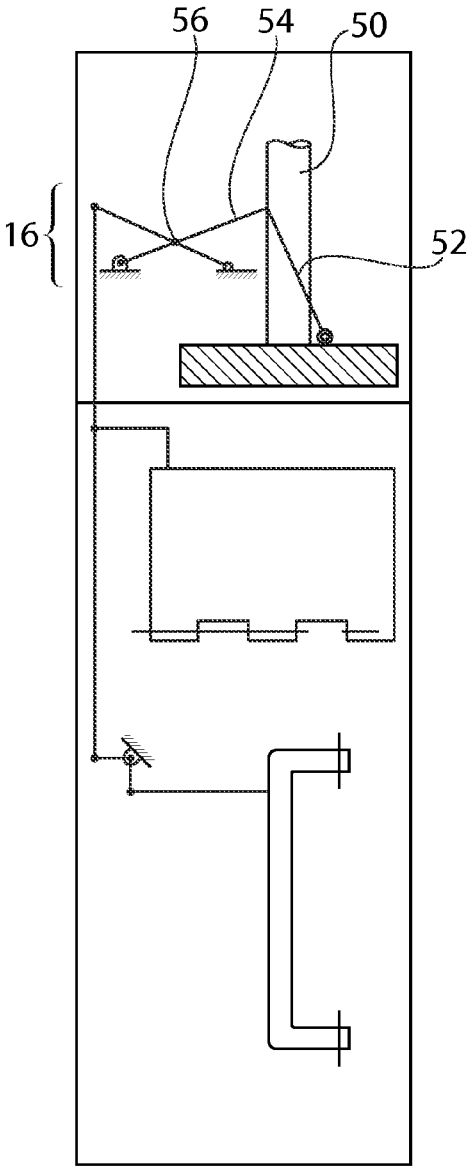
FIGS. 2 and 3 show a front view of the internal workings of a compactor unit with a mechanical actuator and main door interlock.
Figure 3:
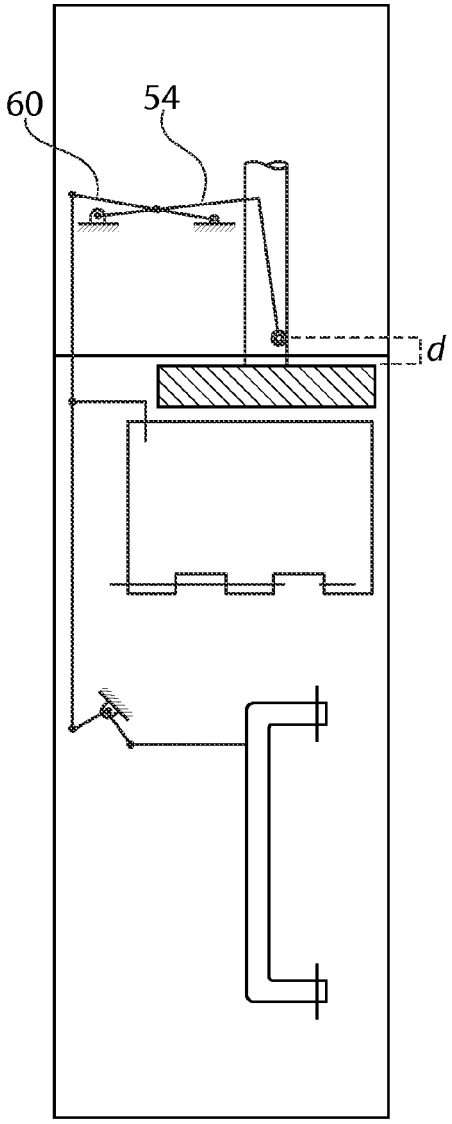
Figure 4:
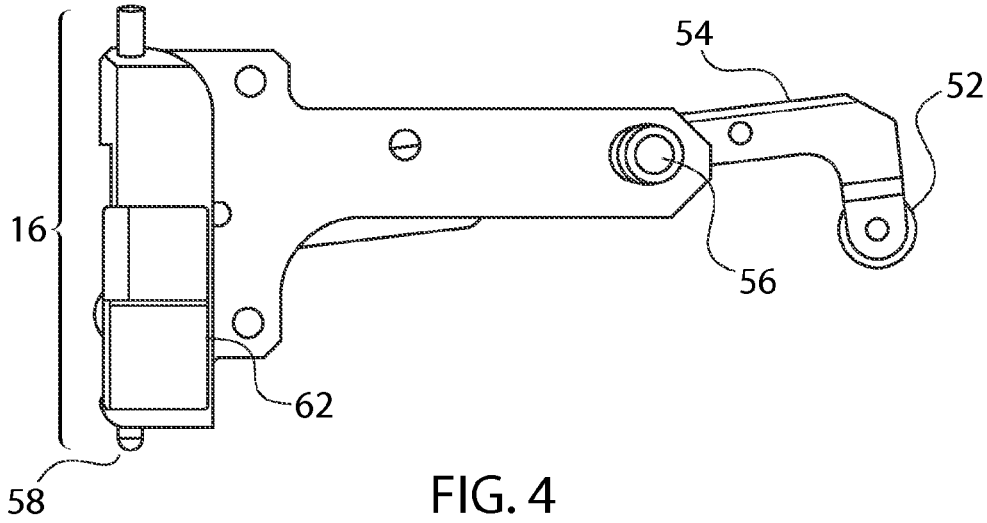
FIG. 4 shows a specific embodiment of a mechanical actuator.

One specific mechanical actuator 16 is shown in FIGS. 2-4. In this specific embodiment, the actuator 16 engages the main door interlock (to restrict access to the main door) by actuating a lock-activating plunger upon movement of the compaction platen 50. As shown in FIG. 2, when the platen 50 is in its upward-most position (i.e., when a compaction cycle is not underway), the compaction platen 50 presses up against or otherwise lifts an arm member 54 that keeps the lock-activating plunger raised. When the plunger is raised, it does not engage the main door interlock. In other words, without the activation of the lock-activating plunger against the main door interlock, the main door interlock maintains a default open position. When the platen 50 begins movement (i.e., when a compaction cycle is underway), the motion of the arm 54 causes the mechanical actuator 16 system to extend a plunger to interact with the main door interlock system in order to cause the door to lock and remain in a locked position (as shown in FIG. 3).

As shown in schematic FIG. 2, when the platen 50 is in its raised position, it causes actuator 16 to take a first platen-contacting position. In this position, a roller ball feature 52 positioned at and end of an arm 54 contacts the platen, which indicates to the system that the platen is in its home position (i.e., that a compaction cycle is not currently underway). Arm 54 may be a movable (e.g., translatable and rotatable) arm that is a part of a spring-loaded linkage 56. Arm 54 may have its non-roller ball end fixedly secured to an internal portion of the unit 10 to provide a lever force. In its home (uppermost) position, the platen 50 exhibits an upward force on the arm 54 and the linkage 56, keeping the main door open. In other words, when the platen 50 is up, the lock is open.

As shown in schematic FIG. 3, when the platen 50 is in a lowered position (or begins the lowering process for a compaction cycle), actuator 16 takes a second platen-distanced position (referred to as "d"). In this position, the movement of the roller ball feature 52 and arm 54 indicates to the system that the platen has moved away from the home position and that a compaction cycle is underway. This causes arm 54 to scissor downwardly against the spring-loaded linkage 56, which also causes downward movement of a translatable bar 60, which causes a plunger 58 (shown in FIG. 4) to extend downwardly and activate the door lock system (described in more detail below). When the platen moves back up, it pulls the roller ball arm back up, and consequently raises the translatable bar 60, which pulls the plunger back up, which releases the main door interlock components described below, allowing the door to be opened.

A specific embodiment of one mechanical actuator 16 is shown in FIG. 4. Roller ball feature 52 is connected to arm 54, and the spring loaded linkage 56 provides a pivot point to allow the arm 54 to navigate movement against the platen 50. Linkage 60 translates the motion from arm 54 into downward movement of actuator 16. Thus, movement of arm 54 against platen 50 causes movement of the linkage bar 60, which causes movement of the plunger 58. FIG. 4 also shows an override switch 62 that may extend to the outside of the compactor to allow a user to lock or unlock the main door independently from the main door interlock system.

Figure 5:
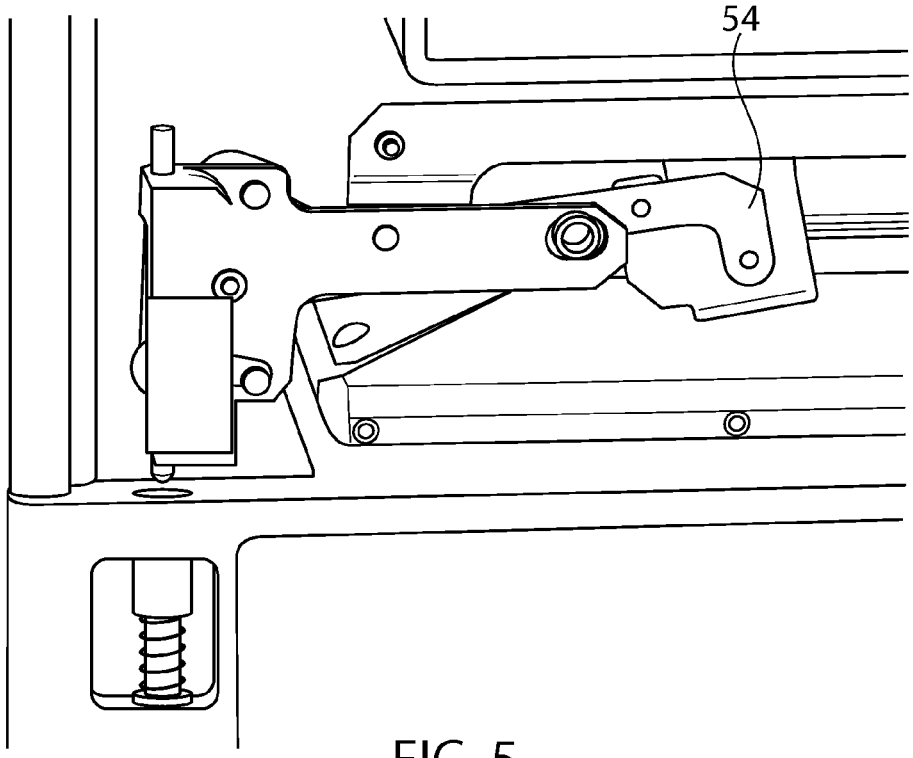
FIGS. 5 and 6 show a mechanical actuator in place on a compactor unit.
Figure 6:
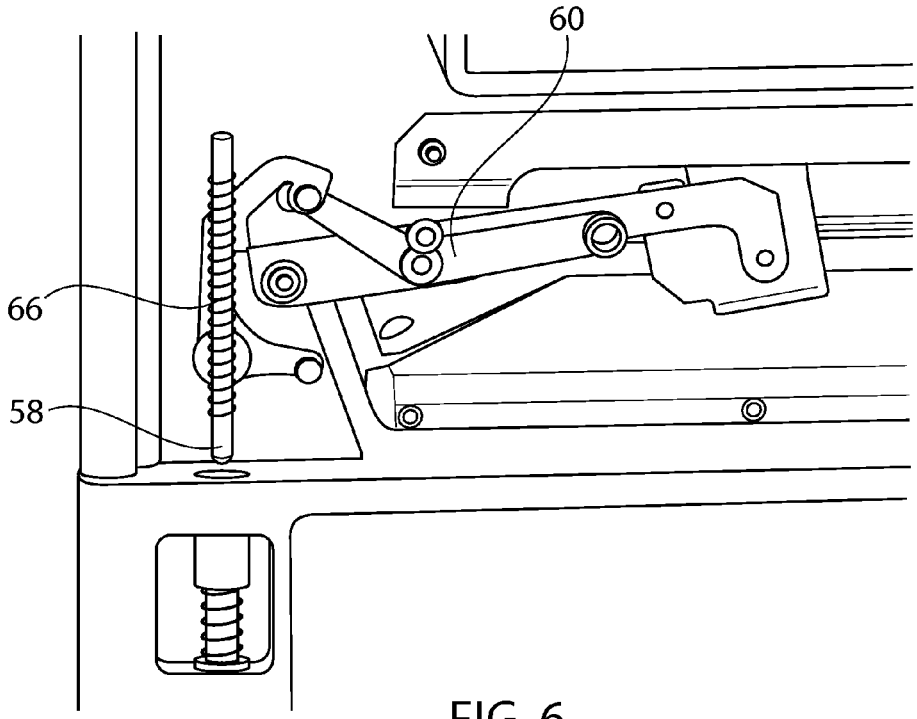
Figure 7:
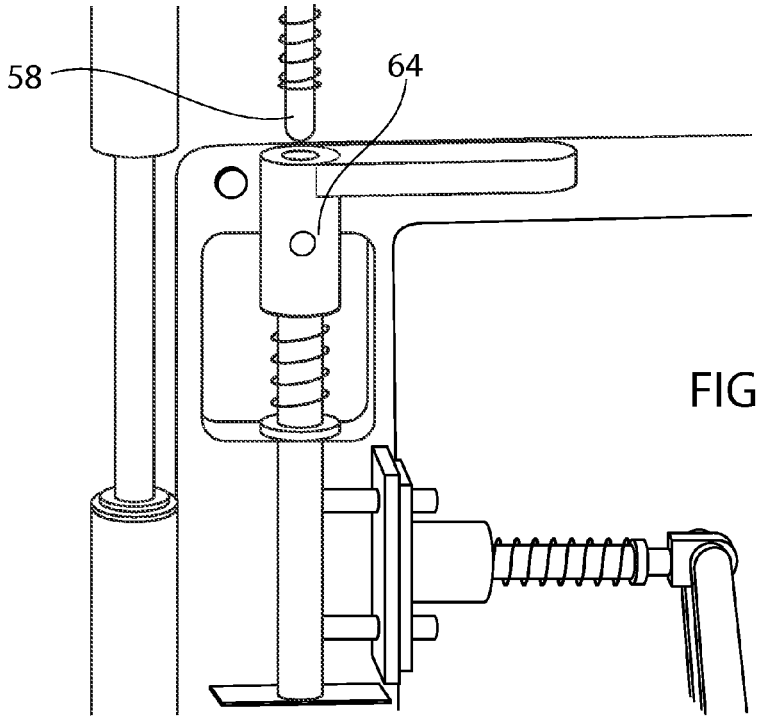
FIG. 7 shows a view of an optional trash door lock.

FIG. 5 shows a mechanical actuator 16 (with arm 54) in place on the unit 10. FIG. 6 shows a cut-away view which illustrates the plunger 58 in more detail. The plunger 58 may be associated with a spring 66 (as well as with the bar 60), which spring loads actuator 16 elements 56, 54, and 52 downwards. As shown in FIG. 7, plunger 58 navigates the division between an upper control box and the main door 12. A trash door lock 64 may also be associated with the plunger 58, such that when the main door interlock is activated in order to lock the main door, the trash door (or waste flap) 18 is also locked. This adds one additional layer of safety to the system.

Although one specific actuator system 16 is described, it should be understood that other mechanical means for accomplishing the actuator function may be used and are considered within the scope of the invention. The general concept is that movement of the platen 50 causes an actuator system 16 to activate a lock for the main door (and optionally, activate a lock for the trash door), and other mechanical interfaces may be used.

Figure 8:
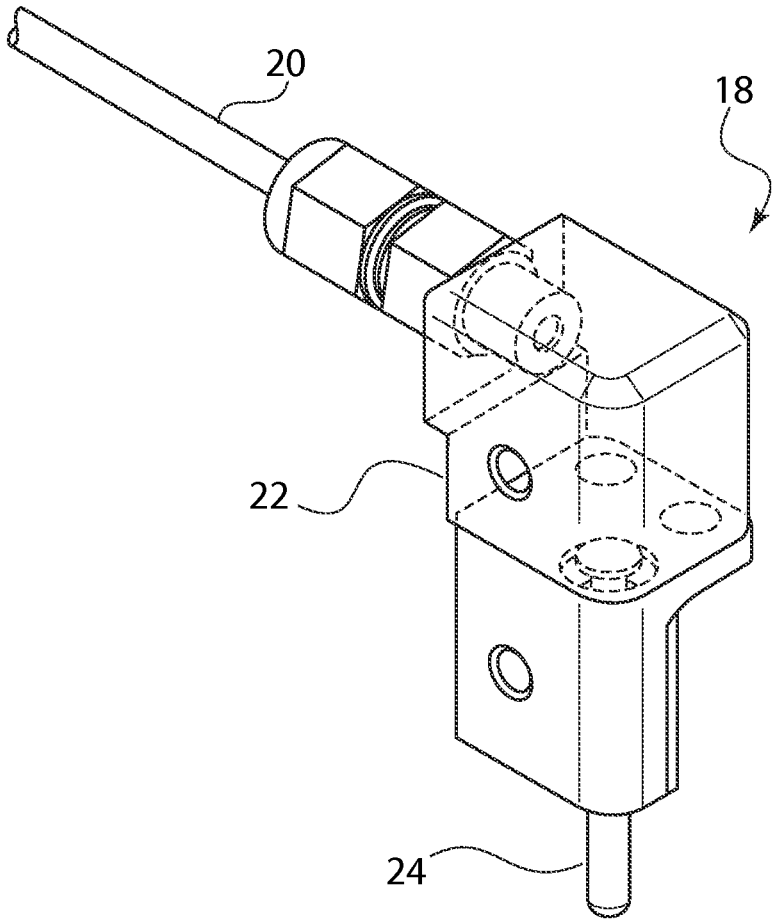
FIG. 8 shows a side perspective view of a hydraulic interlock actuator.

Alternatively, the actuator may be a hydraulic actuator 18, as shown in FIG. 8. In this embodiment, the main door interlock restricts access to the main door by using hydraulic fluid to activate the hydraulic actuator 18. In a specific embodiment, there is provided a hydraulic fluid connection 20, a body actuator 22, and a plunger 24. The hydraulic pressure used to push the cylinders behind the platen is also used to activate the remaining interlock portions. When the platen is activated, the hydraulic actuator extends the plunger 22 to interact with the main door interlock portions, which indicates that the compaction cycle is in progress. When the plunger is not activated, the main door interlock portions maintain a default open position and the main door remains in its unlocked position.

In either embodiment, the actuator 16 or 18 indicates to the system that a compaction cycle is in progress by detecting movement of the platen. It should be understood that there may be other ways to indicate to the system that the compaction cycle is in progress, such as an electrical switch, a solenoid, or any other appropriate indicator or notifier system.

Once the actuator is pushed down or otherwise activated, the main door interlock system 20 locks the main door 12. In a specific embodiment, system 20 is configured to restrict movement (e.g., opening) of the main door handle 14. Although one specific interlock system 20 is described with relating portions below, it should be understood that other mechanical means for accomplishing the locking function may be used and are considered within the scope of the invention.

In a specific embodiment, the locking system 20 may include a vertical rod 26, a hinge member 28, and a horizontal rod 30, all of which are associated with one another or otherwise mechanically engaged. Once actuator 16 or 18 is activated by the beginning of a compression cycle, it applies pressure to the vertical rod 26. This pressure may either be applied by an end of the actuator 16 or by the plunger 22, 58. The pressure from the actuator causes the vertical rod 26 to move down (in the embodiment shown, but it should be understood that the actuator 16 or 18 may be below the vertical rod and thus cause the rod to move up) and press against the hinge member 28.

In a specific embodiment, hinge member 28 comprises two hinge legs 32, 34 connected at a point 36. Point 36 changes the vertical force "V" from the vertical rod 26 into a horizontal force "H." Pressure on hinge member 28 thus causes the horizontal rod 30 to extend toward the handle 14 of the main door 12. Horizontal rod 30 may have a first securing feature 38 and handle 14 may have a corresponding second securing feature 40. In a particular embodiment, the first securing feature 38 on the rod 30 is a pin or other protrusion that extends from the end of rod 30, and the corresponding second securing feature 40 on the handle 14 is an opening or indentation. It should be understood that either of pin or opening may be positioned on either of the rod 30 or the handle 14. It should further be understood that alternate securing features may be used, as long as cooperation therebetween restricts movement of the handle or the door. Features 38 and 40 are dimensioned and configured such that when they are engaged, the handle 14 cannot be pulled and the main door 12 cannot be opened. In the embodiment shown, extension of the horizontal rod 30 causes the rod 30 to restrain the handle 14 of the main door.

Thus, for the mechanical version of the embodiments shown and described, there may be two hinged interfaces. A first hinged interface provides the actuator 16 (which indicates that the compaction process has begun and activates the interlock system) and a second hinged interface 28 provides the main door interlock (which secures the main door handle from being opened). The spacing and positioning of these hinges is intended to maximize space considerations on the trash compactor unit 10, while providing the functional advantages described.

Changes and modifications, additions and deletions may be made to the structures and methods recited above and shown in the drawings without departing from the scope or spirit of the invention and the following claims.

What is claimed is:

1. A trash compactor main door interlock for a main door of a trash compactor having a trash compactor platen for compressing trash, comprising: the trash compactor main door interlock (a) an actuator system configured to indicate that a compaction cycle has begun by detecting downward movement of the trash compactor platen, the actuator system comprising (i) a spring-loaded linkage, (ii) a roller ball arm with a roller feature that contacts the platen when the platen is in a home position and that is distanced from the platen when the platen activates a compaction cycle, (iii) a translatable bar that cooperates with the roller ball arm, and (iv) a plunger that cooperates with the translatable bar, wherein movement of the platen creates a distance between the platen and the roller feature, causing the roller ball arm to move downwardly against the spring-loaded linkage, which causes downward movement of the translatable bar, which causes movement of the plunger; and (b) a lock system activated by the plunger of the actuator system to restrain the main door from opening during movement of the platen, wherein the movement of the plunger activates the lock system to extend a rod toward a handle of the main door, wherein extension of the rod restrains movement of a handle of the main door.

2. The trash compactor main door interlock of claim 1, wherein the lock system is hydraulically activated by hydraulic pressure used to push cylinders that activate the platen.

3. The trash compactor main door interlock of claim 1, wherein the lock system comprises a vertical rod, a hinge member, and a horizontal rod, wherein the actuator causes the vertical rod to press against the hinge member, wherein pressure on the hinge member causes the horizontal rod to extend toward a handle of the main door, wherein extension of the horizontal rod causes the rod to restrain a handle of the main door.

4. The trash compactor main door interlock of claim 3, wherein the horizontal rod comprises a first securing feature configured to cooperate with a corresponding second securing feature on the handle of the main door, such that when the first and second securing features are engaged, the handle cannot be pulled.

5. The trash compactor main door interlock of claim 4, wherein the first securing feature is a pin on the horizontal rod and the second securing feature is an opening on the handle configured to receive the pin.

6. The trash compactor main door interlock of claim 1, wherein the lock system mechanically restrains the main door from opening.

7. The trash compactor main door interlock of claim 6, wherein the lock system further mechanically restrains a trash door from opening.

8. The trash compactor main door interlock of claim 6, wherein the lock system comprises a pin that is inserted against a handle of the main door, preventing the handle from being pulled.

9. The trash compactor main door interlock of claim 1, wherein the actuator system comprises a first hinged system and wherein the lock system comprises a second hinged system.

10. The trash compactor main door interlock of claim 1, wherein the interlock is installed on a trash compactor that is on-board a passenger transport vehicle.

11. A trash compactor main door interlock for a main door of a trash compactor having a trash compactor platen for compressing trash, comprising: the trash compactor main door interlock (a) an actuator system configured to indicate that a compaction cycle has begun by detecting downward movement of the trash compactor platen, the actuator system comprising (i) a spring-loaded linkage, (ii) a roller ball arm with a roller feature that contacts the platen when the platen is in a home position and that is distanced from the platen when the platen activates a compaction cycle, (iii) a translatable bar that cooperates with the roller ball arm, and (iv) a plunger that cooperates with the translatable bar, wherein movement of the platen creates a distance between the platen and the roller feature, causing the roller ball arm to move downwardly against the spring-loaded linkage, which causes downward movement of the translatable bar, which causes movement of the plunger; and (b) a lock system activated by the plunger to restrain the main door from opening during movement of the platen.

12. The trash compactor main door interlock of claim 11, wherein the lock system comprises a rod and a handle of the main door, wherein activation of the plunger extends the rod toward the handle of the main door to restrain movement of the handle.

* * * * *